US011565383B2

(12) United States Patent
Mesnil et al.

(10) Patent No.: US 11,565,383 B2
(45) Date of Patent: Jan. 31, 2023

(54) ELECTRICALLY ISOLATED ADAPTER

(71) Applicant: APEX BRANDS, INC., Apex, NC (US)

(72) Inventors: Pierre Mesnil, Columbia, SC (US); Rolf Reitz De Swardt, Blythewood, SC (US)

(73) Assignee: APEX BRANDS, INC., Apex, NC (US)

( * ) Notice: Subject to any disclaimer, the term of this patent is extended or adjusted under 35 U.S.C. 154(b) by 0 days.

(21) Appl. No.: 17/055,714

(22) PCT Filed: Jun. 24, 2019

(86) PCT No.: PCT/US2019/038668
§ 371 (c)(1),
(2) Date: Nov. 16, 2020

(87) PCT Pub. No.: WO2020/005805
PCT Pub. Date: Jan. 2, 2020

(65) Prior Publication Data

US 2021/0205962 A1 Jul. 8, 2021

Related U.S. Application Data

(60) Provisional application No. 62/690,047, filed on Jun. 26, 2018.

(51) Int. Cl.
*B25B 13/06* (2006.01)
*B25B 23/00* (2006.01)

(52) U.S. Cl.
CPC ..... *B25B 13/065* (2013.01); *B25B 23/0035* (2013.01); *B25B 23/0042* (2013.01); *B25B 23/0071* (2013.01)

(58) Field of Classification Search
CPC ..... B25B 13/065; B25B 23/0035; B25B 23/0042; B25B 23/0071; B25B 15/001;
(Continued)

(56) References Cited

U.S. PATENT DOCUMENTS 2,025,838 A 12/1935 Van
2,457,451 A 12/1948 Domack
(Continued)

FOREIGN PATENT DOCUMENTS

CA 2231130 C 2/2002
CN 2062679 U 9/1990
(Continued)

OTHER PUBLICATIONS

International Search Report and Written Opinion from related international application PCT/US2019/038668, dated Oct. 1, 2019, all pages cited in its entirety.
(Continued)

*Primary Examiner* — Joseph J Hail
*Assistant Examiner* — Caleb Andrew Holizna
(74) *Attorney, Agent, or Firm* — Burr & Forman LLP

(57) ABSTRACT

An electrically isolated adapter may include a drive body made of first metallic material extending along a common axis, a driven body made of a second metallic material extending along the common axis, and an isolation assembly formed of insulating material disposed between the drive body and the driven body. The drive body may include a drive head configured to interface with a socket or fastener. The insulating material has a resistance to electrical current that is higher than the resistance to electrical current of at least one of the first metallic material and the second metallic material. The driven body may include a drive receiver configured to interface with a protrusion of a driving tool. A portion of one of the drive body or the driven
(Continued)

body is received inside a portion of the other of the drive body or the driven body such that the drive body and driven body overlap each other along the common axis.

18 Claims, 11 Drawing Sheets

(58) Field of Classification Search
CPC ..... B25B 13/06; B25B 13/56; H01B 17/56; H02K 7/145
USPC ..... 81/121.1
See application file for complete search history.

(56) References Cited

U.S. PATENT DOCUMENTS

| | | | | |
|---|---|---|---|---|
| 2,476,762 | A | 7/1949 | Petre et al. | |
| 3,859,821 | A | 1/1975 | Wallace | |
| 3,868,874 | A | 3/1975 | Olashaw | |
| 3,873,863 | A | 3/1975 | Pew | |
| 4,927,403 | A | 5/1990 | Pate | |
| 5,485,769 | A | 1/1996 | Olson | |
| 5,970,826 | A | 10/1999 | Iwinski et al. | |
| 6,029,547 | A | 2/2000 | Eggert et al. | |
| 6,126,882 | A | 10/2000 | Iwinski et al. | |
| 6,295,904 | B1 | 10/2001 | Webb | |
| 6,962,098 | B2 | 11/2005 | Eggert et al. | |
| 7,077,037 | B2 | 7/2006 | Shevela | |
| 7,841,261 | B2 | 11/2010 | Milligan et al. | |
| 7,882,769 | B2 * | 2/2011 | Lin | G09F 3/00 81/436 |
| 9,144,893 | B2 | 9/2015 | Su | |
| 9,827,654 | B2 | 11/2017 | Su | |
| 9,863,191 | B1 | 1/2018 | Ide | |
| 10,435,954 | B1 | 10/2019 | Ide | |
| 10,675,738 | B2 | 6/2020 | Heitkamp | |
| 10,753,159 | B1 | 8/2020 | Ide | |
| 10,906,161 | B2 | 2/2021 | Xu | |
| 11,027,400 | B2 | 6/2021 | Raskin et al. | |
| 2008/0309444 | A1 | 12/2008 | Sorg et al. | |
| 2012/0042754 | A1 | 2/2012 | Chen | |
| 2012/0060656 | A1 | 3/2012 | Chang | |
| 2013/0341069 | A1 * | 12/2013 | Demaretz | F16D 3/78 174/138 R |
| 2015/0336246 | A1 | 11/2015 | Peters et al. | |
| 2016/0082582 | A1 | 3/2016 | Barker | |

FOREIGN PATENT DOCUMENTS

| | | | |
|---|---|---|---|
| CN | 2073351 | U | 3/1991 |
| CN | 101121259 | A | 2/2008 |
| CN | 201963668 | U | 9/2011 |
| CN | 103029088 | A | 4/2013 |
| CN | 203726391 | U | 7/2014 |
| CN | 204226465 | U | 3/2015 |
| DE | 3144901 | A1 | 5/1983 |
| DE | 202018102624 | U1 | 5/2018 |
| DE | 102018118335 | A1 | 1/2020 |
| EP | 0747179 | A1 | 12/1996 |
| EP | 0861139 | A1 | 9/1998 |
| EP | 1047529 | A1 | 11/2000 |
| EP | 2673518 | A1 | 12/2013 |
| FR | 2240083 | A1 | 3/1975 |
| WO | 2017106701 | A1 | 6/2017 |
| WO | 20170106701 | A1 | 6/2017 |
| WO | 2018204468 | A1 | 11/2018 |

OTHER PUBLICATIONS

Office Action from related Chinese application No. 2019295630, dated Apr. 27, 2021, all pages cited in its entirety.
Examination Report from related Australian application No. 202010400526.4, dated Jun. 2, 2021, all pages cited in its entirety.
Office Action from related U.S. Appl. No. 16/607,133 dated Jan. 13, 2021, all pages cited in its entirety.
Office action from related Chinese application No. 201880029152.0, dated Jan. 4, 2021, all pages cited in its entirety.
Office action from related Mexican application No. MX/a/2020/012109, dated Jan. 21, 2021, all pages cited in its entirety.
International Search Report and Written Opinion of PCT/US2016/067256 dated May 17, 2017, all enclosed pages cited.
Chapter 1 International Preliminary Report on Patentability of PCT/US2016/067256 dated Jun. 19, 2018, all enclosed pages cited.
International Search Report and Written Opinion of PCT/US2018/030603 dated Aug. 17, 2018, all enclosed pages cited.
First office action from corresponding Chinese Application No. 201680081860.X dated Jun. 3, 2019, all enclosed pages cited.
European Search Report from related European Applicatoin No. 19207774.1 dated Mar. 3, 2020, all enclosed paged cited.
International Search Report and Written Opinion of international application No. PCT/US2020/018041 dated May 4, 2020, all enclosed pages cited.
Office action from related Chinese Application No. 201880029152.0 dated Jun. 10, 2020, all enclosed pages cited.
International Search Report and Written Opinion of international application No. PCT/US2020/026592 dated Jul. 21, 2020, all enclosed pages cited.
Office action from Chinese application No. 2019800389557 dated Oct. 20, 2021, all pages cited in its entirety.
Extended European Search Report from European Application No. 21208161.6 dated Feb. 18, 2022, all pages cited in its entirety.
Extended European Search Report issued in corresponding European Application No. 19824659.7 dated Jul. 6, 2022, all enclosed pages cited.
Extended European Search Report issued in corresponding European Application No. 22169149.6 dated Aug. 4, 2022, all enclosed pages cited.

* cited by examiner

FIG. 9.
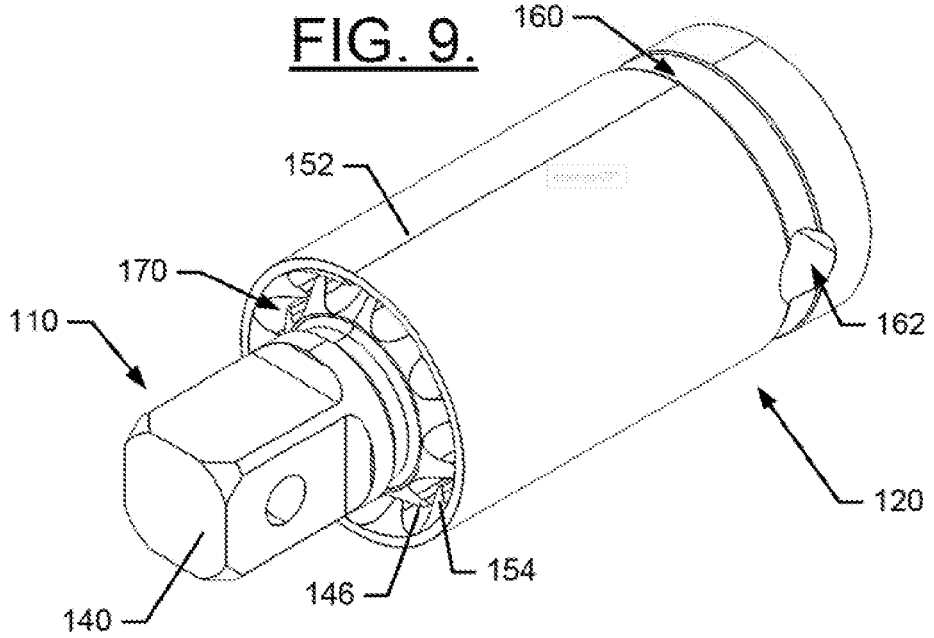
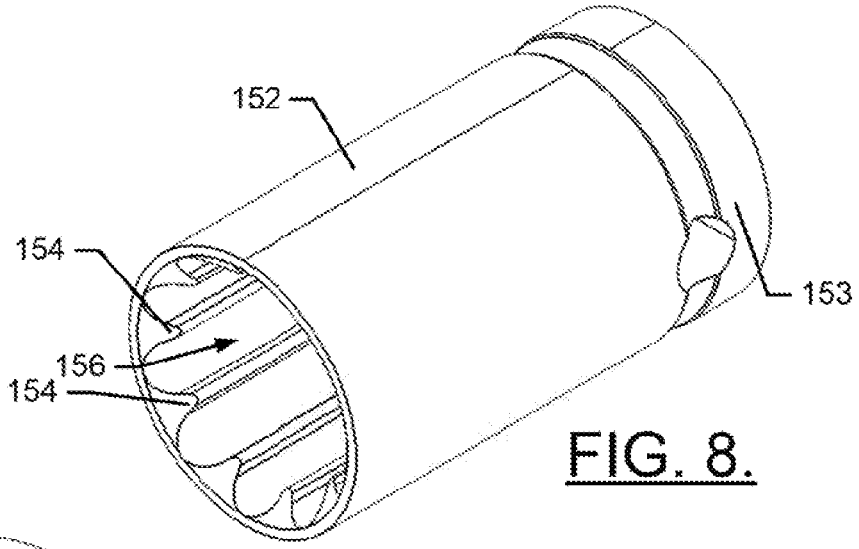
FIG. 8.
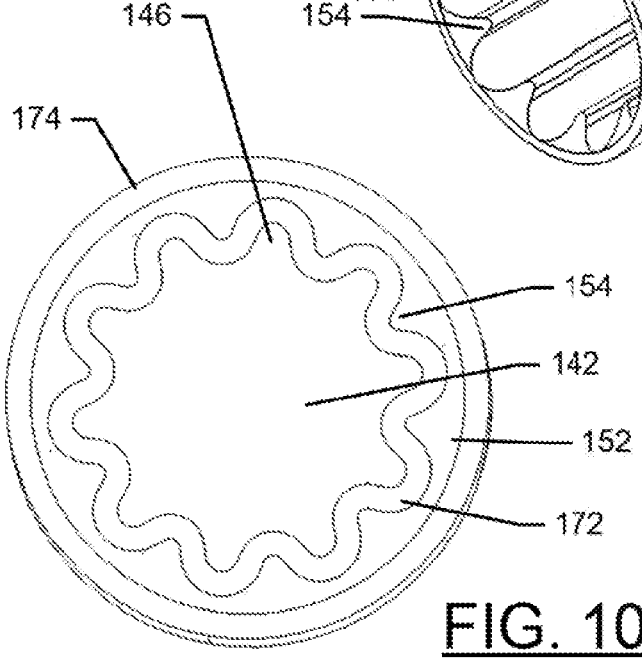
FIG. 10.

FIG. 23.
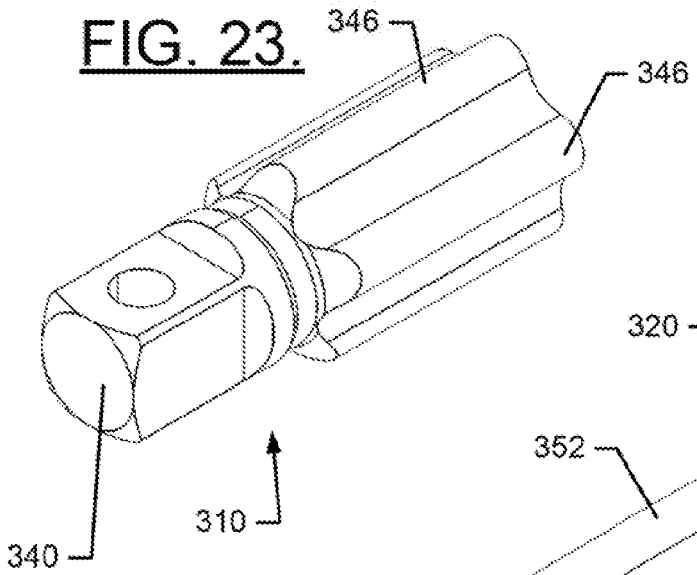
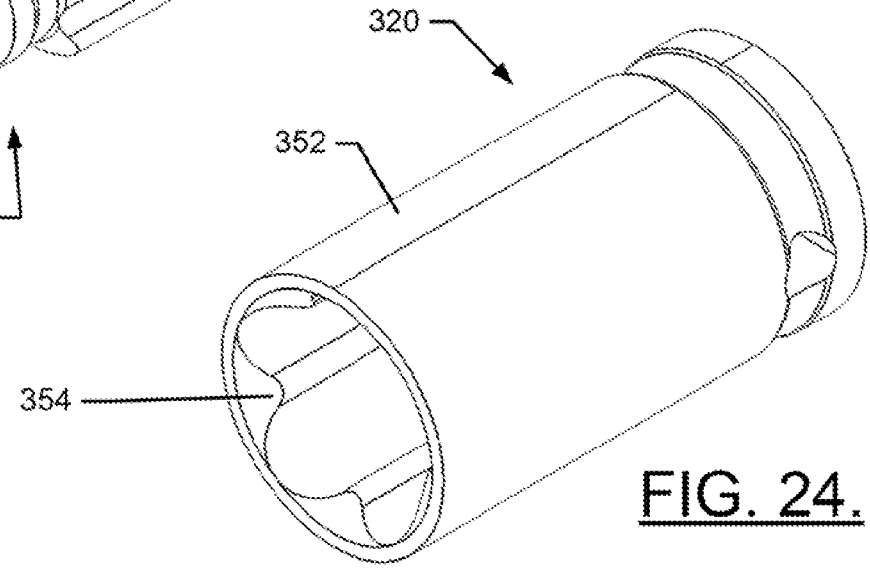
FIG. 24.
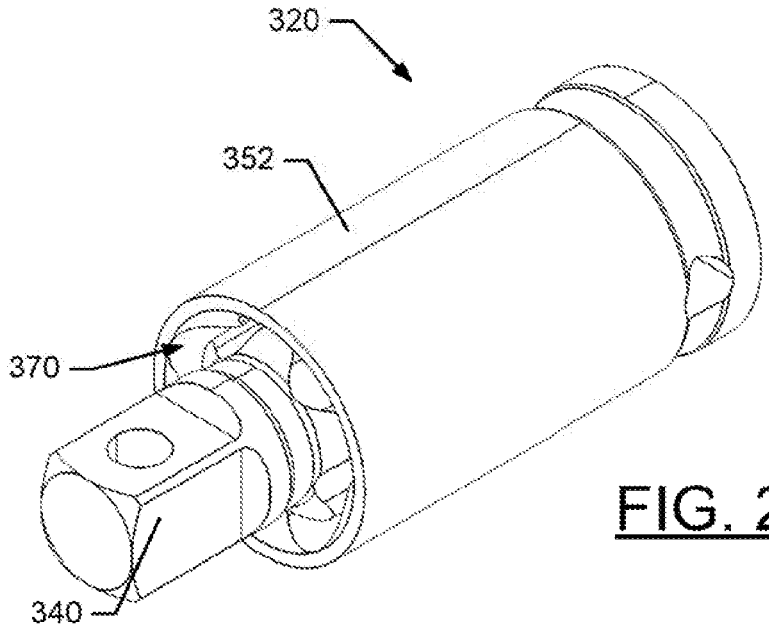
FIG. 25.

FIG. 28.
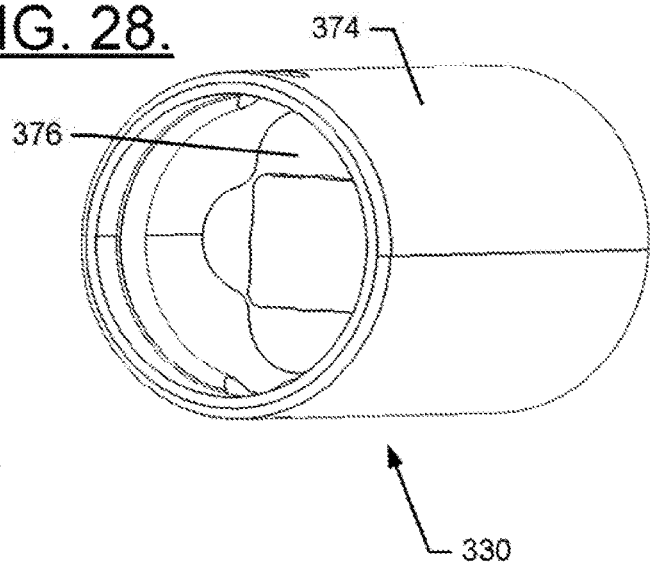
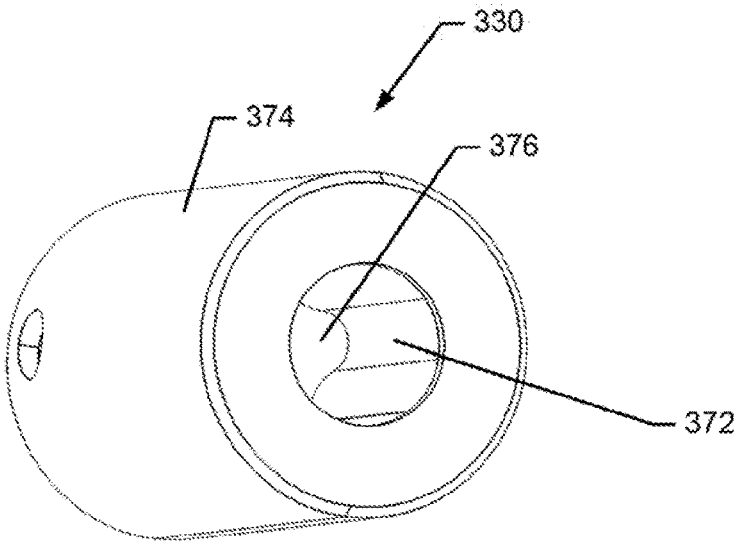
FIG. 29.
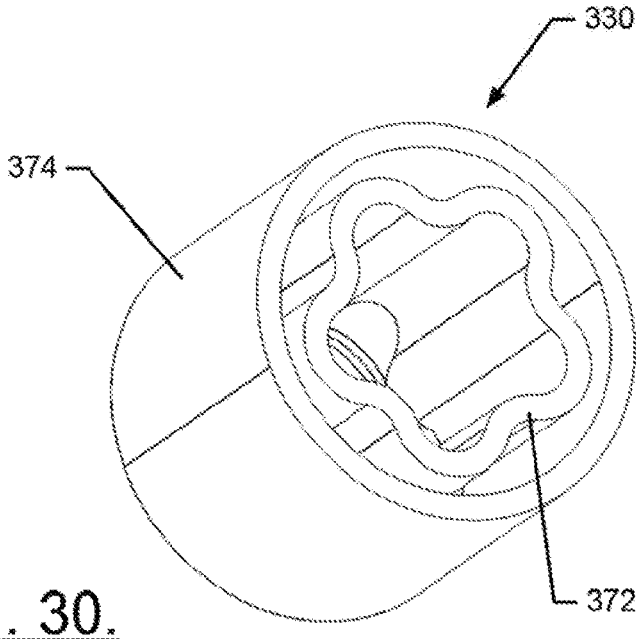
FIG. 30.

ELECTRICALLY ISOLATED ADAPTER

CROSS REFERENCE TO RELATED APPLICATIONS

This application claims priority to U.S. application Ser. No. 62/690,047 filed Jun. 26, 2018, the entire contents of which are hereby incorporated by reference in its entirety.

TECHNICAL FIELD

Example embodiments generally relate to hand tools and, in particular, relate to an adapter tool that is desirable for use in environments where work occurs around electrically charged components.

BACKGROUND

Socket tools, such as socket wrenches, are familiar tools for fastening nuts and other drivable components or fasteners. The sockets of these tools are generally removable heads that interface with a drive square on the socket wrench on one side and interface with one of various different sizes of nut or other fastener on the other side. The sizes of the interface at either end of the socket (i.e., the size of the receivers for both receiving the drive square and receiving the nut or fastener) are typically fixed at standard sizes. Similarly, the size of the drive square on each individual socket wrench is also fixed at a standard size.

Some users may have a vast array of wrenches and socket sets to ensure that a matching drive square is available for each socket and wrench combination. However, many users prefer to employ an adapter (or adapter set) to allow a smaller number of individual pieces to be owned to still effectively utilize the range of sockets and/or wrenches that such users may own. These adapters may also, in some cases, extend the effective length of the socket along the axis of rotation to allow the socket to be used to reach recessed nuts or fasteners. Regardless of the specific purpose for use, adapters are popular, and often essential, toolkit additions for many users.

Because high torque is often applied through these tools, and high strength and durability is desirable, the sockets, wrenches and adapters are traditionally made of a metallic material such as iron or steel. However, metallic materials can also corrode or create spark or shock hazards when used around electrically powered equipment. In the past, it has been both possible and common to coat portions of a metallic socket, wrench or adapter in a material that is non-conductive, such material is typically not suitable for coverage of either the driven end of the socket/adapter (i.e., the end that interfaces with the wrench) or the driving end of the socket/adapter (i.e., the end that interfaces with the nut or other fastener being tightened by the socket or the end that interfaces with the socket for the adapter), or the working end of the wrench (including especially the drive square, drive hex, or other drive head). The high torque and repeated contact with metallic components would tend to wear such materials away over time and degrade the performance of the tool. Thus, it is most likely that the ends of the socket would remain (or revert to) exposed metallic surfaces so that the socket would potentially conduct electricity and be a shock or spark hazard.

Thus, it may be desirable to provide a new design for electrical isolation of such tools.

BRIEF SUMMARY OF SOME EXAMPLES

Some example embodiments may enable the provision of an adapter that includes a driven end and driving end that are electrically isolated. In this regard, each of the driven end and the driving end may be formed of separate metallic bodies that are electrically isolated from each other via an over-molding process. The metallic bodies may be formed to be coextensive along at least a portion of their axial lengths.

In an example embodiment, an electrically isolated adapter is provided. The adapter may include a drive body made of first metallic material extending along a common axis, a driven body made of a second metallic material extending along the common axis, and an isolation assembly formed of insulating material disposed between the drive body and the driven body. The drive body may include a drive head configured to interface with a socket or fastener. The insulating material has a resistance to electrical current that is higher than the resistance to electrical current of at least one of the first metallic material and the second metallic material. The driven body may include a drive receiver configured to interface with a protrusion of a driving tool. A portion of one of the drive body or the driven body is received inside a portion of the other of the drive body or the driven body such that the drive body and driven body overlap each other along the common axis.

Another embodiment discloses a driver extension. The driver extension may include a head having a first end configured to mate with a driver (e.g. socket wrench, screwdriver, etc.) and a second end having a plurality of splines disposed around an outer circumference of the second end, the head being made of a first material. The driver extension further includes a tail having a third end having an opening and a plurality of trenches disposed around a circumference of the open end and a fourth end configured to mate with a driven body (e.g. bolt, nut, screw, etc.) the tail being made of a second material. The driver extension also includes a body made of a material that has a resistance to electrical current that is greater than the resistance to electrical current of at least one of the first material and the second material, the body being at least partially disposed between the head and the tail. In this embodiment the first end is disposed within the opening of the third end.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

FIG. 8 illustrates another front perspective view of the driven body according to an example embodiment;

FIG. 9 is a perspective view of the drive body inserted into the driven body prior to injection of insulating material therebetween according to an example embodiment;

FIG. 10 is a cross section view taken through a midpoint of the adapter along a plane that is substantially perpendicular to the axis of rotation of the adapter according to an example embodiment;

FIG. 23 illustrates an isolated perspective view of a drive body of the adapter according to an example embodiment;

FIG. 24 illustrates an isolated perspective view of a driven body of the adapter according to an example embodiment;

FIG. 25 illustrates the drive body and driven body assembled prior to injection molding of an isolation assembly 330 according to an example embodiment;

FIG. 28 illustrates an isolated rear perspective view of the isolation assembly of the adapter according to an example embodiment;

FIG. 29 illustrates an isolated front perspective view of the isolation assembly of the adapter according to an example embodiment;

FIG. 30 is a cross section view of the isolation assembly taken at a center thereof and perpendicular to the common axis according to an example embodiment;

DETAILED DESCRIPTION

Figure 2:
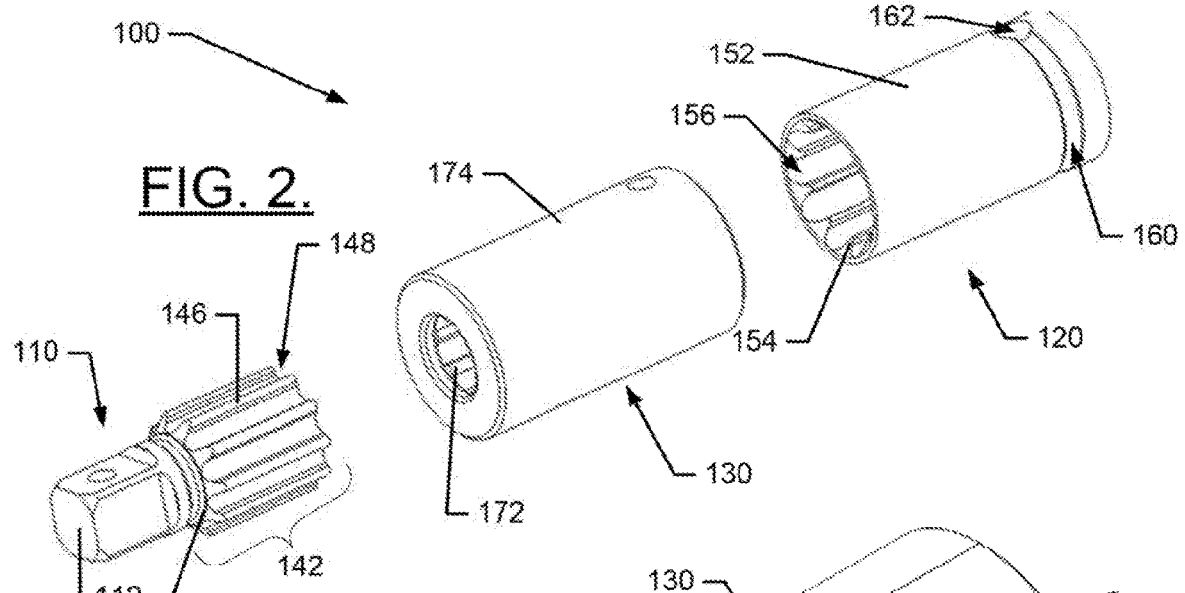
FIG. 2 illustrates an exploded perspective view of the adapter according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

As indicated above, some example embodiments may relate to the provision of electrically isolated socket tools that can be used in proximity to powered components or components that have an electrical charge. In some cases, the user can safely work on or around such components or systems without having to de-energize the system. The electrical isolation provided may minimize the risk of surge currents traveling from a fastener to a socket tool (such as a socket wrench or a power tool that drives sockets). Particularly for power tools that include electronic components that log data about power tool usage, the isolated socket can protect the electronic components and valuable computer data such as recorded torque information on fasteners and run-down count history for estimating power tool life.

Past efforts to provide isolation involving driving adapters or sockets have involved two metallic bodies that are separated longitudinally, and that have used fiber wound (or braided) composite tubes or injection molded or compression molded short fiber composites such as glass filled Nylon to hold the two metallic bodies apart and transfer torque. These designs tend to have long lengths and large diameters. The long lengths are typically due to the gap provided between the bodies, and the large diameters are due to the large volume of composite material needed to allow torque transfer without breaking the composite material between the bodies or that engages the bodies. The resulting structure includes no overlapping of the metallic bodies along any portion of the axis of the adapter or socket.

Example embodiments provide the driven end and the drive end to include metallic bodies that are configured to overlap each other over at least a portion of their respective lengths. In particular, the metallic body on the drive end (e.g., the drive body) and the metallic body on the driven end (e.g., the driven body) may each include corresponding structures that extend parallel to each other and to the axis to mutually reinforce each other in an overlap region with insulating material being interposed between the drive and driven bodies. As a result, metallic materials extend over the full length of the adapter so that the diameter of the adapter can be substantially smaller than conventional adapters. Additionally, since the drive and driven bodies overlap along the axial lengths thereof, there is no need to define a substantial gap therebetween along the longitudinal (or axial) length of the adapter, and the overall length of the adapter can be reduced if desired. Lengths of adapters made according to example embodiments can therefore be selected based on specific applications and without regard to defining a gap between the bodies. Meanwhile, the diameters of such adapters can be about equal to (or even less than) twice the length of the drive head (e.g., drive square, drive hex, etc.).

Figure 1:
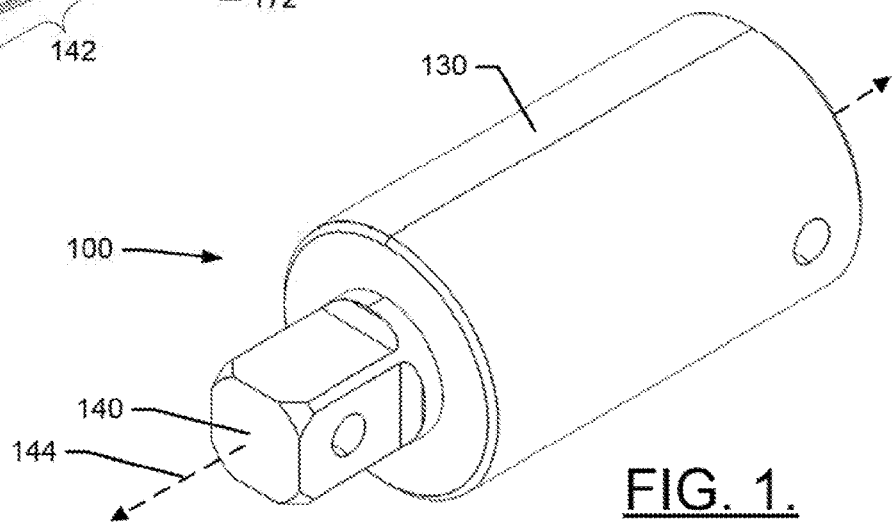
FIG. 1 illustrates a perspective view of an electrically isolated adapter according to an example embodiment.
Figure 3:
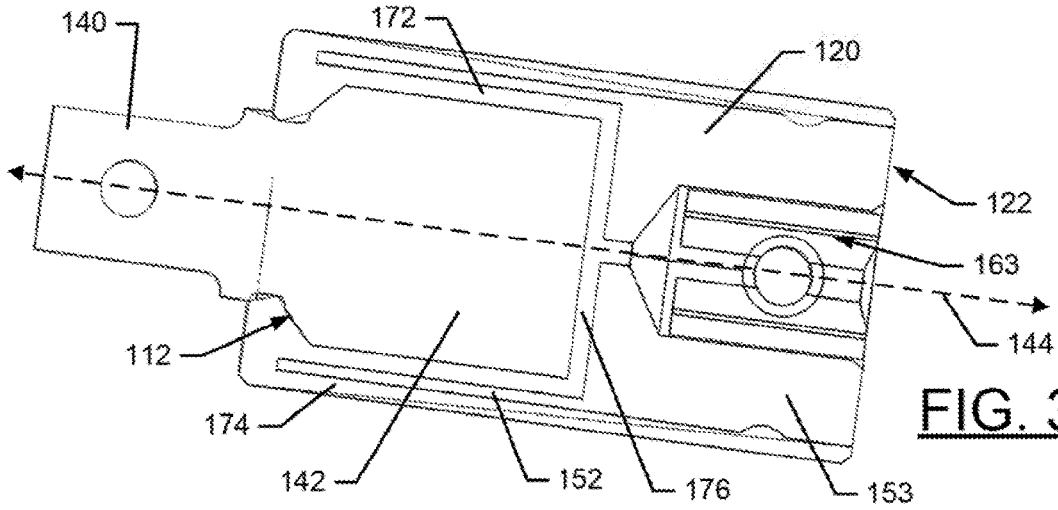
FIG. 3 illustrates a cross section view of the adapter taken along the axis of rotation of the adapter according to an example embodiment.
Figure 4:
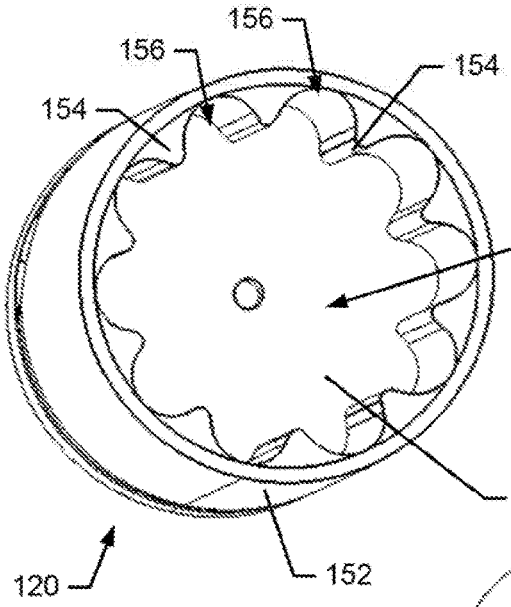
FIG. 4 illustrates a front perspective view of a driven body of the adapter according to an example embodiment.
Figure 5:
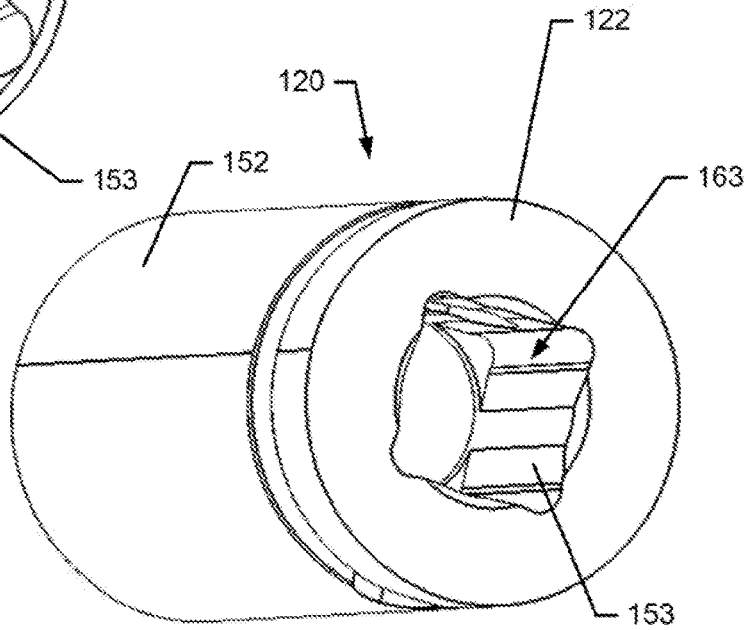
FIG. 5 is a rear perspective view of the driven body according to an example embodiment.
Figure 6:
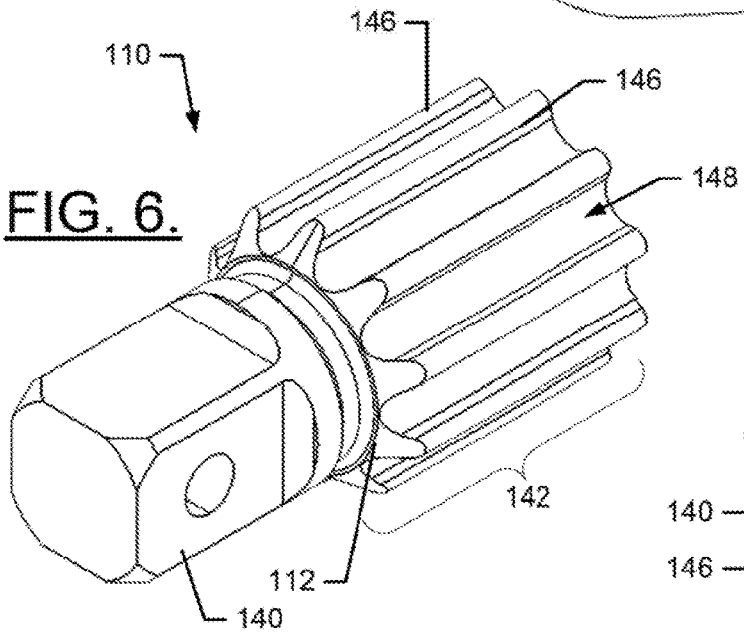
FIG. 6 is a front perspective view of a drive body of the adapter according to an example embodiment.

FIG. 1 illustrates a perspective view of an electrically isolated adapter 100 according to an example embodiment, and FIG. 2 illustrates an exploded perspective view of the adapter 100. FIG. 3 illustrates a cross section view of the adapter 100 taken along the axis of rotation of the adapter (which is also the longitudinal axis of the adapter 100). FIGS. 4-8 illustrate various isolated views of a drive body 110 and driven body 120 of the adapter 100 to further facilitate an understanding of how an example embodiment may be structured. FIG. 9 is a perspective view of the drive body 110 inserted into the driven body 120 prior to injection of insulating material therebetween. FIG. 10 is a cross section view taken through a midpoint of the adapter 100 along a plane that is substantially perpendicular to the axis of rotation of the adapter.

Referring to FIGS. 1 to 10, in addition to the drive body 110 and the driven body 120, the adapter 100 may include an isolation assembly 130 that is configured to separate the drive body 110 from the driven body 120 and also cover substantially all of the lateral edges of the driven body 120. The drive body 110 and driven body 120 may each be made of steel or another rigid metallic material. Steel or other rigid metals generally have a low resistance to electrical current passing therethrough. The drive body 110 and the driven body 120 may be designed such that, when assembled into the adapter 100, the drive body 110 and the driven body 120 do not contact each other. The drive body 110 and the driven body 120 may be oriented such that a drive end 112 of the drive body 110 and a driven end 122 of the driven body 120 face in opposite directions. Axial centerlines of each of the drive body 110 and the driven body 120 are aligned with each other and with a longitudinal centerline of the adapter 100.

The drive body 110 may include a drive head 140, which faces away from the driven body 120 and protrudes out of the isolation assembly 130. The drive head 140 may be configured to interface with a socket, a fastener, or any other component having a receiving opening that is complementary to the shape of the drive head 140. In this example, the drive head 140 is a drive square. However, other shapes for the drive head 140 are also possible, as will be demonstrated below. In some embodiments, a ball plunger may be disposed on a lateral side of the drive head 140 to engage with a ball detent disposed on a socket or other component.

Figure 7:
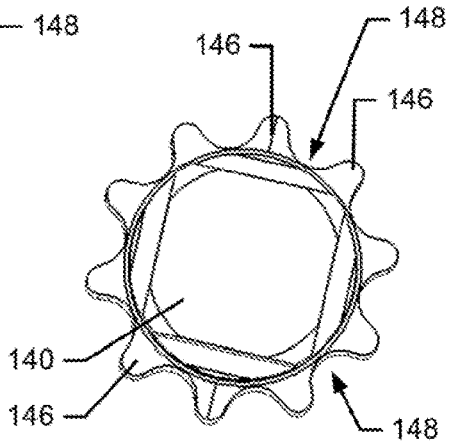
FIG. 7 is a front view of the drive body of the adapter according to an example embodiment.

The drive body 110 may also include drive body shaft 142 that may be configured to extend rearward from the drive head 140. Both the drive head 140 and the drive body shaft 142 may share a common axis 144, which is also the rotational and longitudinal axis of the drive body 110 and the adapter 100. As can be appreciated from FIGS. 2, 6 and 7, the drive body shaft 142 may be a splined shaft. As such, for example, a plurality of splines 146 (e.g., longitudinally extending ridges, protrusions or teeth) may extend parallel to the common axis 144 along a periphery of the drive body shaft 142. Between each of the splines 146, a longitudinally extending trench 148 may be formed. As shown in FIG. 7, this example embodiment includes ten splines 146 and ten trenches 148, but any desirable number of splines 146 and trenches 148 could be employed in other example embodiments.

As can also be appreciated from FIG. 7, the splines 146 may extend radially outward from a cylindrical core of the drive body shaft 142. The cylindrical core portion of the drive body shaft 142 may have a diameter that is about equal to a diagonal length between opposing corners of the drive head 140. The splines 146 may extend away from the cylindrical core portion by between about 5% and 25% of the diameter of the cylindrical core portion of the drive body shaft 142, and the diagonal length between opposing corners of the drive head 140. Thus, the diameter of the drive body shaft 142 may be no more than 50% larger than the diagonal length between opposing corners of the drive head 140 (and in some cases as little as 10% larger). In this example, the splines 146 and trenches 148 have a substantially sinusoidal shape when viewed in cross section. However, the splines 146 and trenches 148 could alternatively have sharper edges, if desired.

The driven body 120 may take the form of a cylinder that has been hollowed out to at least some degree to form a drive body receiver 150. The drive body receiver 150 may be formed between sidewalls 152 (which could be considered a single tubular sidewall) of the driven body 120 that define the external peripheral edges of the driven body 120 and radially bound the drive body receiver 150. The sidewalls 152 may extend parallel to the common axis 144 away from a base portion 153. The sidewalls 152 may have longitudinally extending ridges 154 that extend inwardly from the sidewalls 152 toward the common axis 144. The ridges 154 may be separated from each other by longitudinally extending recesses 156. The ridges 154 and recesses 156 may be equal in number to the number of splines 146 and trenches 148 of the drive body 110 and may be formed to be substantially complementary thereto. However, the diameter of the drive body receiver 150 may be larger than the diameter of the drive body shaft 142 so that the ridges 154 remain spaced apart from corresponding portions of the trenches 148 and the splines 146 remain spaced apart from corresponding portions of the recesses 156.

In some cases, the driven body 120 may further include an annular groove 160 that may include a receiver 162 formed in the base portion 153. In this regard, the annular groove 160 may be formed around a periphery of the base portion 153. The annular groove 160 and/or the receiver 162 may be used for facilitating affixing the driven body 120 to the power tool or wrench that is used to drive the adapter 100 via passing of a pin through the receiver 162, or via a ball plunger being inserted into the receiver 162 as described above from a drive head of the power tool or wrench. Thus, the receiver 162 may extend through the driven body 120 (at the annular groove 160) substantially perpendicular to the common axis 144 of the adapter 100. The annular groove 160 may be provided proximate to (but spaced apart from) the driven end 122. A drive receiver 163 may also be formed in the driven end 122 to receive the drive head of the power tool or wrench that operably couples to the adapter 100. In other words, the drive receiver 163 may be formed through the base portion 153 along the common axis 144.

When the drive body 110 is inserted into the driven body 120 (as shown in FIG. 9), an inside surface of the sidewalls 152 may appear corrugated and complementary to an outside surface of the drive body shaft 142, which also appears corrugated, but spaced apart from the sidewalls 152 by a gap 170. The drive body 110 and the driven body 120 may be maintained spaced apart from each other in this manner (such that no portion of either touches any portion of the other) while an insulating material (e.g., rubber, plastic, resin, or other such materials) is injected therebetween as part of an injection molding operation. The insulating material has a high resistance to electrical current passing therethrough; in one embodiment the resistance to electrical current of the insulating material is several orders of magnitude higher than the resistance to electrical current of stainless steel. The insulating material may fill the gap 170 and define a corrugated or fluted separator 172 separating the sidewalls 152 from the drive body shaft 142, and thereby also separating the splines 146 and trenches 148 from the recesses 156 and ridges 154, respectively. The insulating material may entirely fill the gap 160 and any other spaces between the drive body 110 and the driven body 120, and may also be molded over the outside surface of the sidewalls 152 of the driven body 120 and the drive end 112. The driven end 122 could also be covered, although some embodiments (including this example) may leave the driven end 122 uncovered. The insulating material may, once cured, form the isolation assembly 130. Although outside the scope of the present disclosure, additional components may be provided and/or designed to enable retention of the drive body 110 and driven body 120 relative to each other during the injection molding process. Accordingly, the drive body 110 and the driven body 120 may be clamped effectively in an injection molding machine during the injection molding process to ensure that the pressure stays balanced and the respective parts do not move during the injection process and result in uneven thickness of the insulating material.

As can be appreciated from the descriptions above, the isolation assembly 130 may be defined at least by the fluted separator 172 and an outer cup 174, which may be substantially cylindrical in shape extending along the outer edges of the sidewalls 152. The fluted separator 172 may engage the outer cup 174 at forward most edges (with the driving head 140 being considered the front for reference) of the fluted separator 172 and the outer cup 174. Meanwhile, distal ends of the fluted separator 174 may be joined by a separation base 176. The separation base 176 may be a plate shaped portion of the isolation assembly 130 that extends perpendicular to the common axis 144 and separates the base portion 153 from the distal end of the drive body shaft 142. Thus, the outer cup 174 may mate with the fluted separator 172 such that the fluted separator 172 is essentially inserted into the outer cup 174. The drive body shaft 142 may be essentially fully encased within the fluted separator 172 and separation base 176 with only the drive head 140 extending out of the isolation assembly 130. Meanwhile, the sidewalls 152 may be fully encased between the fluted separator 172 and the outer cup 174 such that (due to the further coverage provided by the separation base 176) effectively an entirety of the driven body 120 is also nearly fully encased with (in this example) only the driven end 122 uncovered. Thus, effectively all of the driven body 120 other than the driven end 122 may be encased by the isolation assembly 130.

In an example embodiment, both the drive body 110 and the driven body 120 may be made of metallic material (e.g., stainless steel, or other rigid and durable alloys). By making the drive body 110 and driven body 120 of metallic material, the drive body 110 and driven body 120 may each be very durable and able to withstand large amounts of force, torque and/or impact even while themselves being relatively thin and short. Meanwhile, injection-molding the isolation assembly 130 around and between the drive body 110 and the driven body 120 using a non-metallic and insulating material may render the drive body 110 and driven body 120 electrically isolated from each other. Thus, although the advantages of using metallic material are provided with respect to the interfacing portions of the adapter 100, the disadvantages relative to use in proximity to electrically powered or charged components may be avoided.

As noted above, the isolation assembly 130 may be formed around the drive body 110 and the driven body 120 by injection molding to securely bond and completely seal the adapter 100 other than the drive head 140 and the driven end 122. The fluted separator 172 extends between the sidewalls 152 of the drive shaft body 142, which otherwise overlap each other along the common axis 144. This overlap allows the pressure exerted on each of the ridges 154 of the driven body 120 to be distributed substantially evenly and transmitted to the splines 146 of the drive body 110 through the fluted separator 172. However, since the fluted separator 172 is mutually supported on opposing sides thereof (e.g., by the complementary shapes of the splines 146 and trenches 148 with the recesses 156 and ridges 154, respectively) by the overlapping portions of the drive shaft body 142 and the sidewalls 152, the fluted separator 172 is not prone to breakage even if the fluted separator 172 is made relatively thin (e.g., 0.5 mm to 2 mm). In particular, the width of the fluted separator 172 (measured in the radial direction) may be less than the radial length of either or both of the ridges 154 and the splines 146. In some cases, the width of the fluted separator 172 may be substantially equal to the width of the outer cup 174 (again measured in the radial direction). Accordingly, the overall diameter and length of the drive body 110 and the driven body 120 (and correspondingly also the adapter 100) may be kept substantially smaller than conventional adapters. In particular, for example, a length of each of the drive body 110 and the driven body 120 may be between about three times and four times a length of the drive head 140. Additionally, a length of the adapter 100 along the common axis 133 may be between about four times and five times the length of the drive head 140. In some cases, a width of the drive body 110 may be less than 50% larger than a width of the drive head 140, and a width of the adapter 100 may be less than three times the width of the drive head 140. In some cases, a maximum diameter of the drive body shaft 142 may be greater than a minimum diameter of the driven body 120 over all portions of the driven body 120 where there are sidewalls 152. Thus, at each and every radial distance from the common axis 133, there is metal from either the drive body shaft 142 or the sidewalls 152, and there is also radial overlap of metal from each component in the transition region defined between the troughs of the trenches 148 and the recesses 156. In some embodiments, it may be advantageous to increase the number of lobes or splines as the size of the drive head 140 (or drive body 110) increases. This increase in the number of splines causes an increase in the effective radius of torque transfer. Thus, examples described herein will include 5 lobes for the ⅜" drive head and more lobes for larger drive heads. The sinusoidal shape and uniform thickness of the resulting fluted separator 174 may be advantageous as well because it reduces stress concentrations.

The general design principles described above in reference to FIGS. 1-10 may be applied in other contexts as well. For example, the number, size and shapes of the splines/ridges can be altered to suit any desired drive head combination (both on the adapter 100 and received by the adapter 100). Similarly any size and shape for the drive heads (both on the adapter 100 and received by the adapter 100). In this regard, FIGS. 11-17 illustrate examples of an alternate drive head shape (namely a hex shaped drive head), and FIGS. 18-32 illustrate examples of an adapter having an alternative spline/ridge number and size (which may correlate to a different drive square size).

Figure 11:
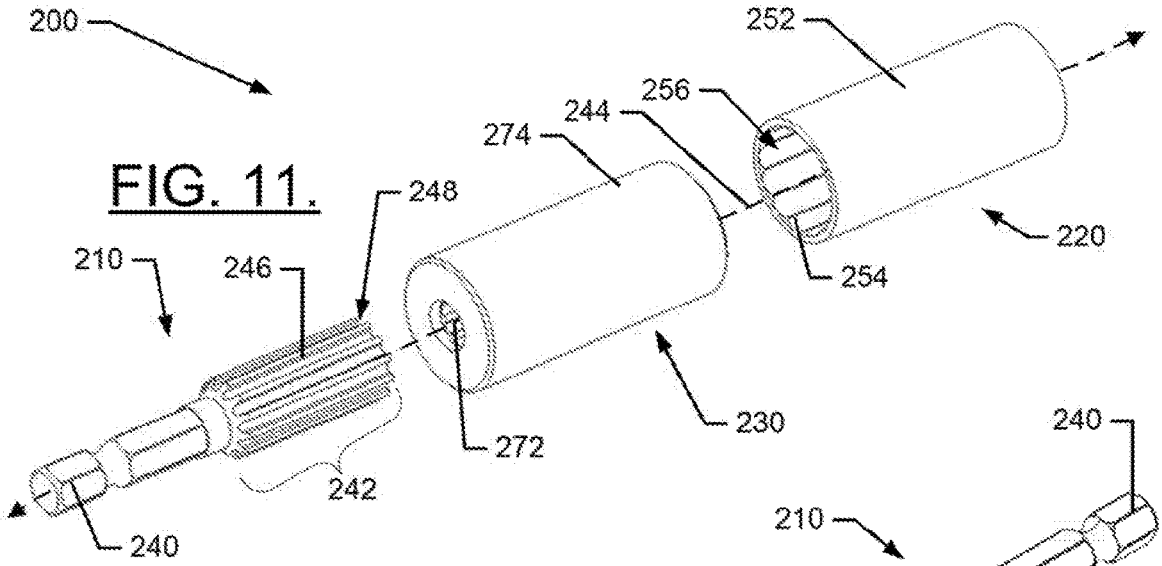
FIG. 11 illustrates an exploded perspective view of an adapter from a front perspective according to an example embodiment.
Figure 12:
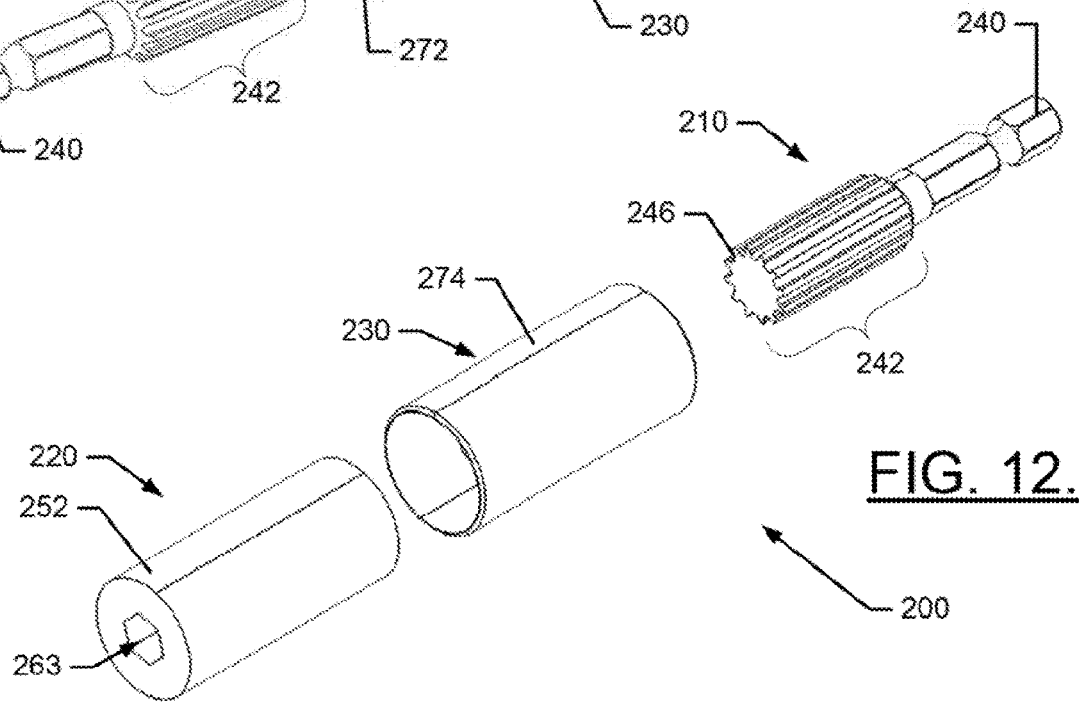
FIG. 12 illustrates an exploded perspective view of an adapter from a rear perspective according to an example embodiment.
Figure 13:
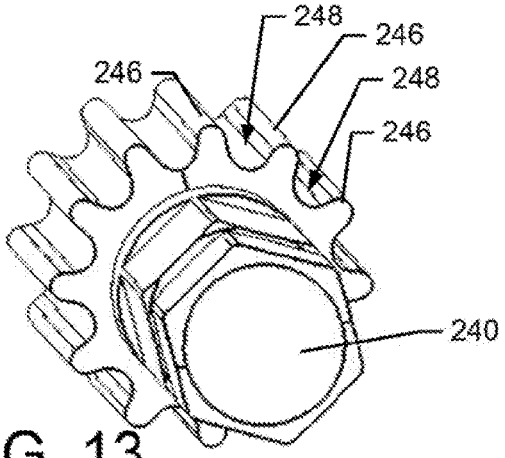
FIG. 13 illustrates an isolated front perspective view of a drive body of the adapter according to an example embodiment.
Figure 14:
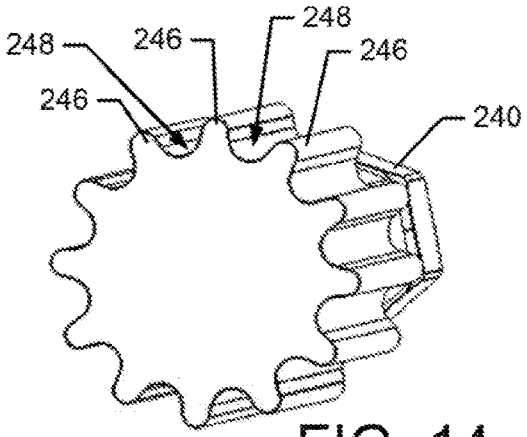
FIG. 14 illustrates an isolated rear perspective view of the drive body of the adapter according to an example embodiment.
Figure 15:
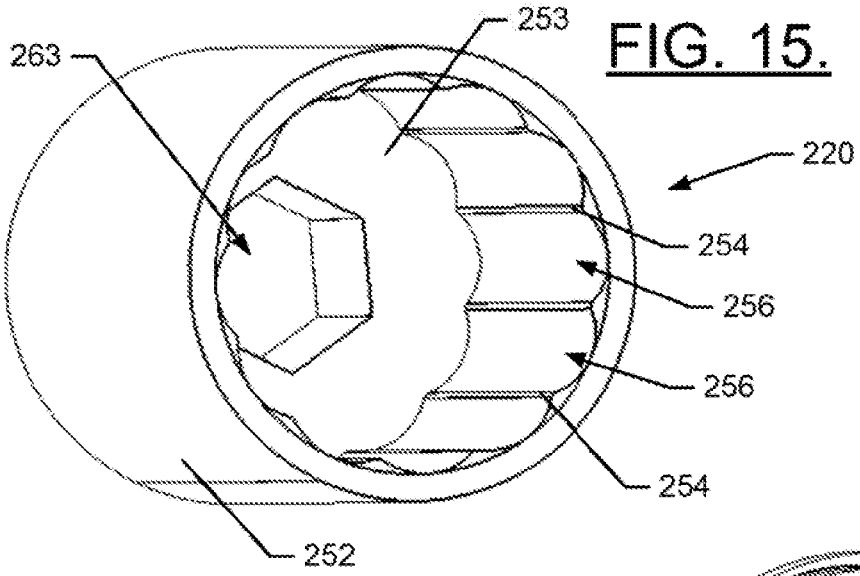
FIG. 15 illustrates an isolated, front perspective view of a driven body of the adapter according to an example embodiment.
Figure 16:
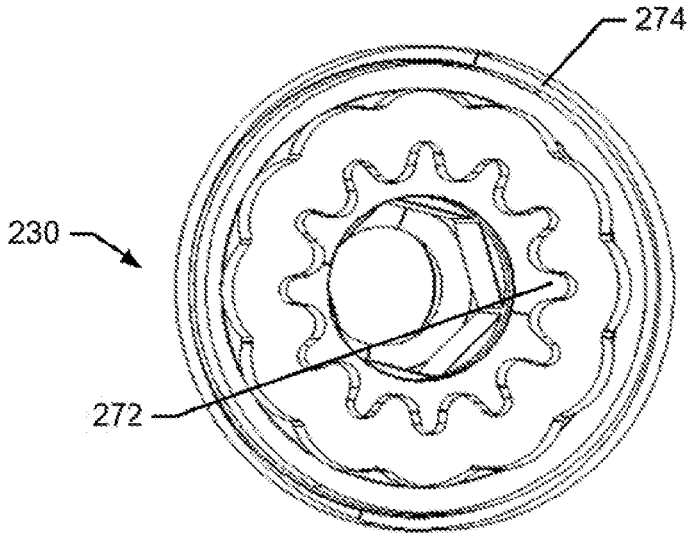
FIG. 16 illustrates an isolated view of an isolation assembly of the adapter perpendicular to its longitudinal axis from a rear perspective and in cross section taken through a center of the isolation assembly according to an example embodiment.
Figure 17:
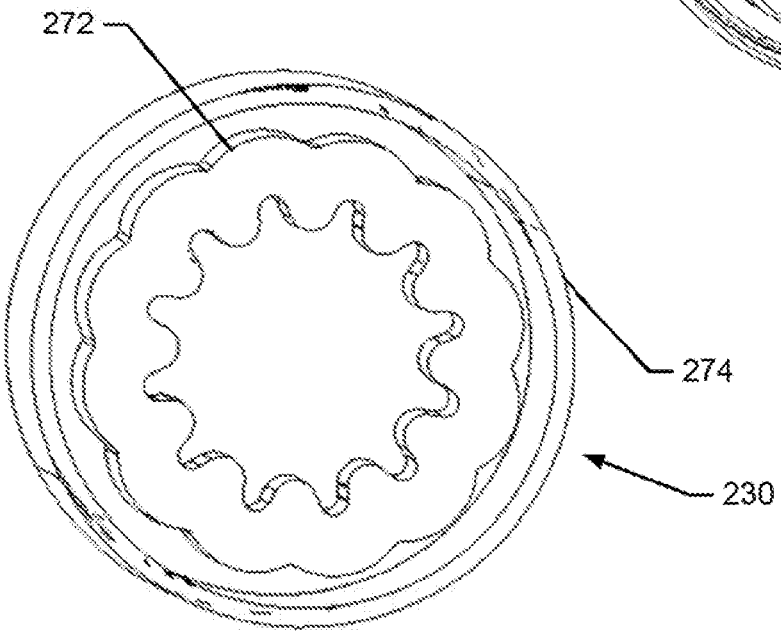
FIG. 17 illustrates an isolated view of an isolation assembly of the adapter perpendicular to its longitudinal axis from a front perspective and in cross section taken through the center of the isolation assembly according to an example embodiment.

Referring now to FIGS. 11-17, an adapter 200 of another example embodiment is shown. FIGS. 11 and 12 illustrate exploded perspective views of the adapter 200 from front and rear perspectives. FIGS. 13 and 14 illustrate isolated perspective views of a drive body 210 of the adapter 200 from front and rear perspectives. FIG. 15 illustrates an isolated, front perspective view of a driven body 220 of the adapter 200. FIGS. 16 and 17 illustrate isolated views of an isolation assembly 230 of the adapter 200 perpendicular to its longitudinal axis from rear and front perspectives, respectively, and in cross section taken through a center of the isolation assembly 230.

As discussed above, the drive body 210 and the driven body 220 may be separated from each other by the isolation assembly 230 that is also configured to cover substantially all of the lateral edges of the driven body 220. The drive body 210 and driven body 220 may each be made of steel or another rigid metallic material to allow for, again, a relatively short and thin construction without sacrificing strength. One of the main differences between the adapter 200 of this example embodiment and the previously discussed adapter 100 is that drive head 240 has a hex shape instead of a square shape, and the drive receiver 263 formed through a base portion 253 of the driven body 220 to receive the drive head of the power tool or wrench that operably couples to the adapter 100 is also hex shaped. Otherwise, the drive body 210 and the driven body 220 may be shaped and structured generally similar to that of the prior example. As such, for example, drive body 210 may also include drive body shaft 242, which may be configured to extend rearward from the drive head 240 sharing a common axis 244 with the drive head 240 (and the driven body 220).

The drive body shaft 242 is also a splined shaft having a plurality of splines 246 that extend parallel to the common axis 244 along a periphery of the drive body shaft 242. A trench 248 may also be formed between each of the splines 246. This example embodiment includes twelve splines 246 and twelve trenches 248. As can also be appreciated from FIGS. 13 and 14, the splines 246 may extend radially outward from a cylindrical core of the drive body shaft 242, and the cylindrical core may again have a diameter similar to the diameter of the drive head 240.

The driven body 220 may take the form of a cylinder that has been hollowed out to at least some degree to form a drive body receiver 250 that is formed between sidewalls 252 (which could be considered a single tubular sidewall) of the driven body 220 to define the external peripheral edges of the driven body 220 and radially bound the drive body receiver 250. The sidewalls 252 may include longitudinally extending ridges 254 that extend inwardly from the sidewalls 252 toward the common axis 244. The ridges 254 may be separated from each other by longitudinally extending recesses 256 or grooves to form a corrugated or fluted appearance in cross section. The ridges 254 and recesses 256 may be equal in number to the number of splines 246 and trenches 248 of the drive body 210 and may align therewith after assembly. However, the diameter of the drive body receiver 250 may be larger than the diameter of the drive body shaft 242 so that the ridges 254 remain spaced apart from corresponding portions of the trenches 248 and the splines 246 remain spaced apart from corresponding portions of the recesses 256 to again form a gap 270 therebetween. During injection molding, the insulating material may fill the gap 270 and define a corrugated or fluted separator 272 separating the sidewalls 252 from the drive body shaft 242, and thereby also separating the splines 246 and trenches 248 from the recesses 256 and ridges 254, respectively. The insulating material may entirely fill the gap 260 and any other spaces between the drive body 210 and the driven body 220, and may also be molded over the outside surface of the sidewalls 252.

FIGS. 16 and 17 show the fluted separator 272 and an outer cup 274, which may be substantially similar to the correspondingly named components described above, in isolation from rear and front perspectives and in cross section. The outer cup 274 may mate with the fluted separator 272 such that the fluted separator 272 is essentially inserted into the outer cup 274 between the drive body shaft 242 and the sidewalls 252. The fluted separator 272 and the outer cup 274 may form the isolation assembly 230 around the drive body 210 and the driven body 220 by injection molding to securely bond and completely seal the adapter 200 other than the drive head 240 (and perhaps also the driven end of the driven body 220). As noted above, the fluted separator 272 extends between the sidewalls 252 of the drive shaft body 242, which otherwise overlap (and are coaxial with) each other along the common axis 244. This overlap allows the pressure exerted on each of the ridges 254 of the driven body 220 to be distributed substantially evenly and transmitted to the splines 246 of the drive body 210 through the fluted separator 272. However, since the fluted separator 272 is mutually supported on opposing sides thereof (e.g., by the complementary shapes of the splines 246 and trenches 248 with the recesses 256 and ridges 254, respectively) by the overlapping portions of the drive shaft body 242 and the sidewalls 252, the fluted separator 272 is not prone to breakage even if the fluted separator 272 is made relatively thin (e.g., 0.5 mm to 2 mm). In this example, however, it can be seen that the width of the fluted separator 272 (measured in the radial direction) is slightly larger than the radial length of either or both of the ridges 254 and the splines 246.

Figure 18:
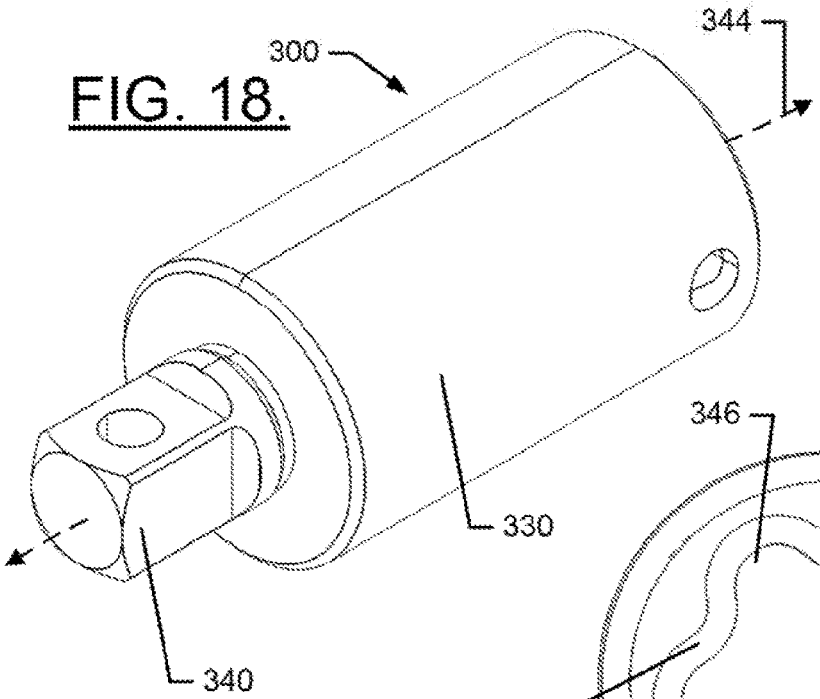
FIG. 18 illustrates a fully assembled, perspective view of another adapter according to an example embodiment.
Figure 19:
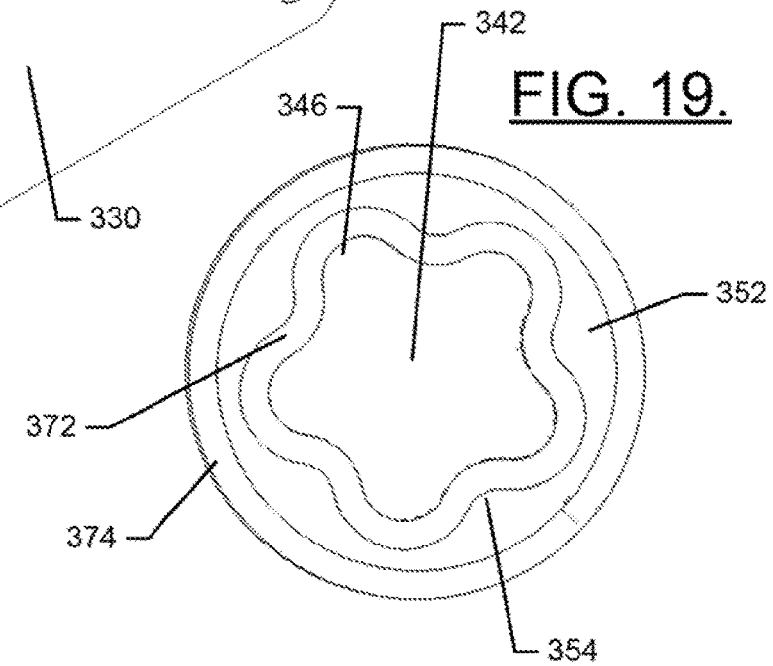
FIG. 19 illustrates a cross section view of the adapter taken through a center thereof perpendicular to the longitudinal axis of the adapter according to an example embodiment.
Figure 20:
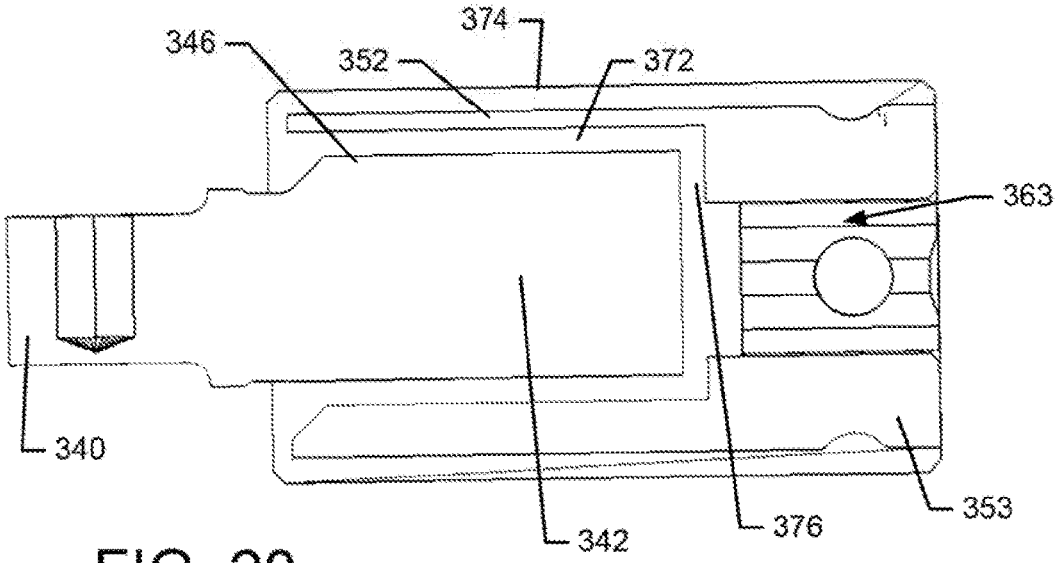
FIG. 20 illustrates a cross section of the adapter view taken along the longitudinal axis according to an example embodiment.
Figure 21:
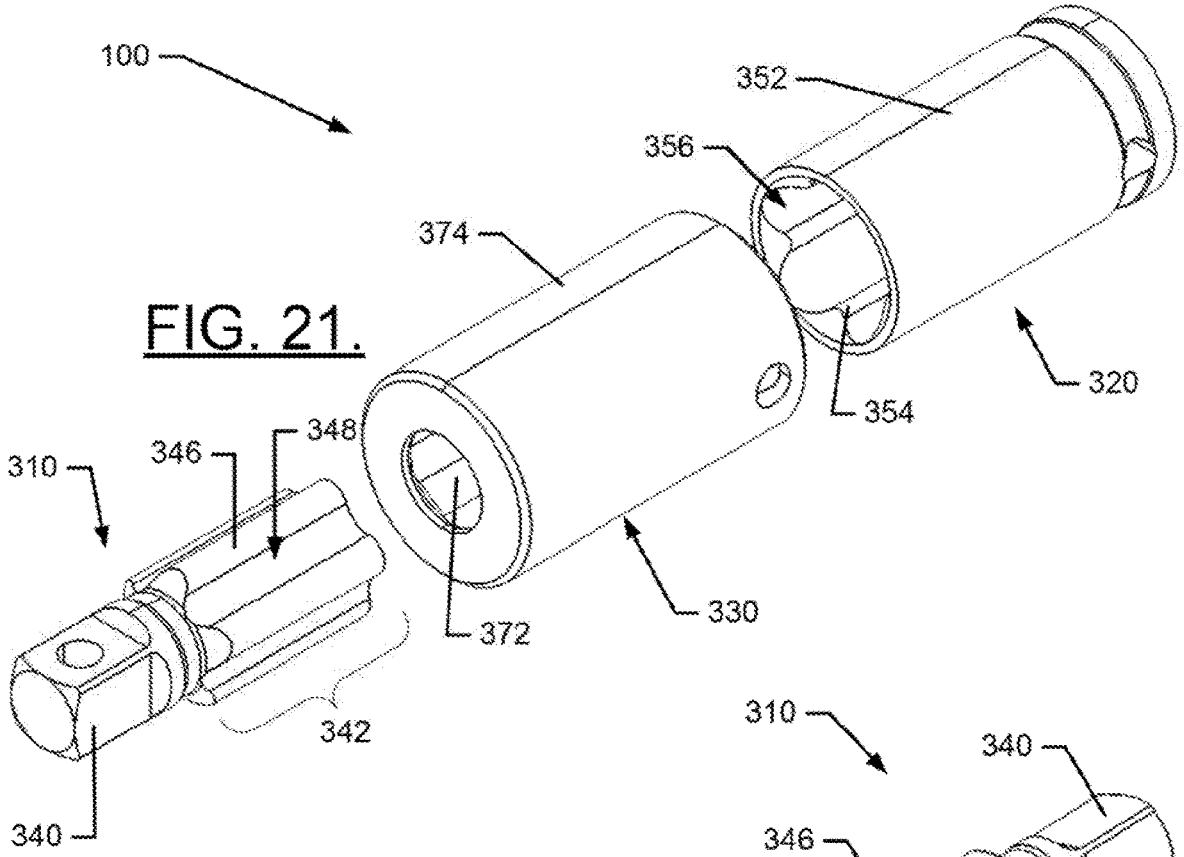
FIG. 21 illustrates an exploded rear perspective view of the adapter according to an example embodiment.
Figure 22:
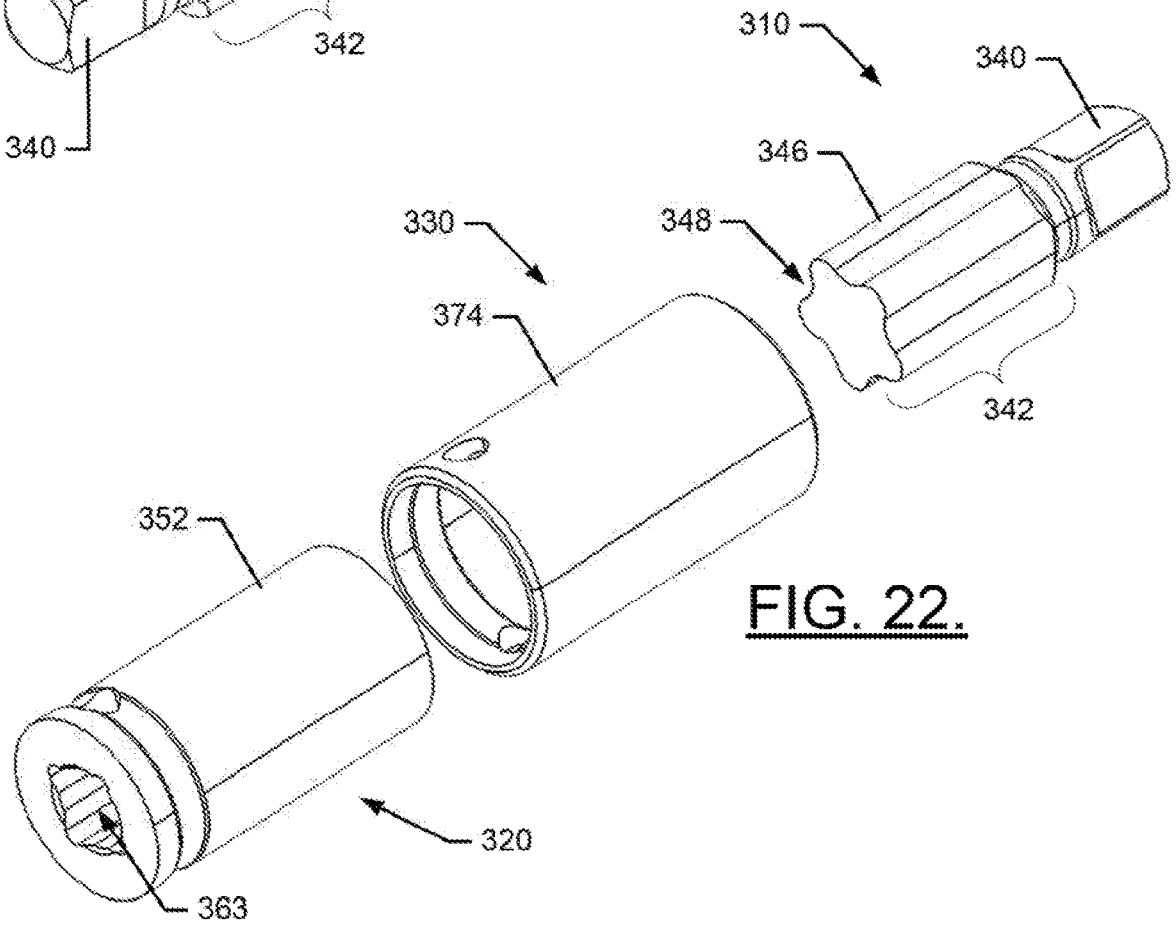
FIG. 22 illustrates an exploded front perspective view of the adapter according to an example embodiment.
Figure 26:
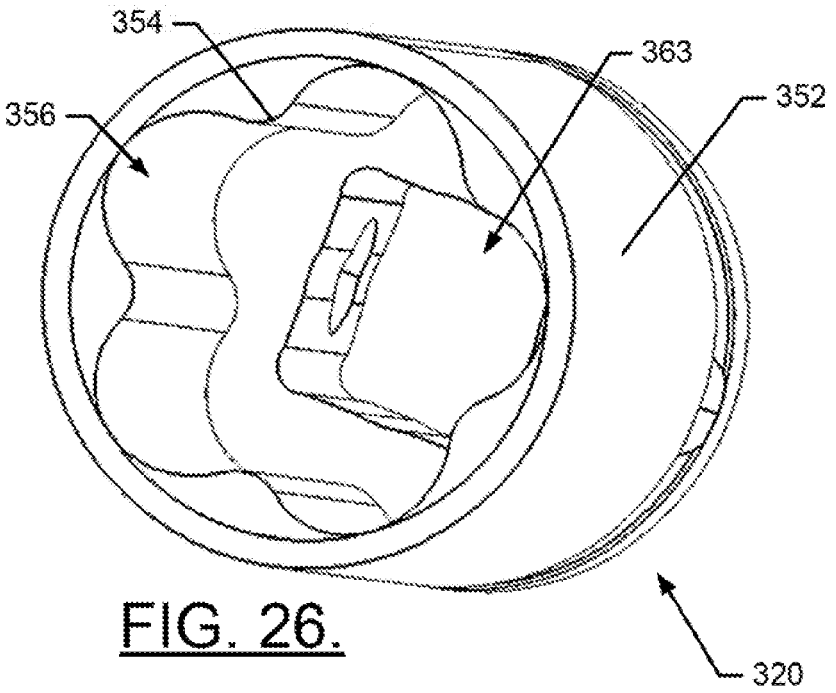
FIG. 26 illustrates an alternative isolated, front perspective view of the driven body of the adapter according to an example embodiment.
Figure 27:
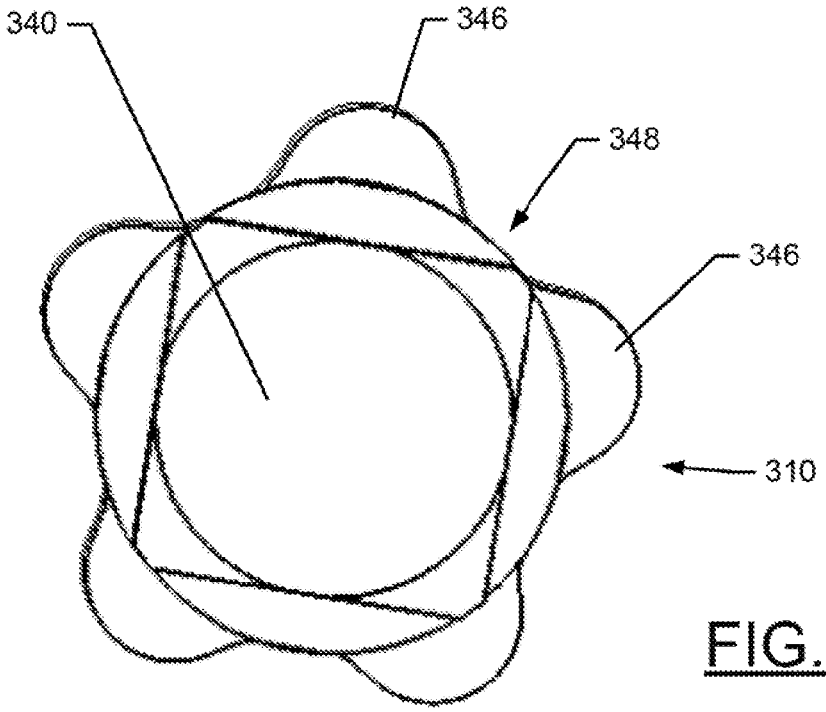
FIG. 27 illustrates a front view of the drive body in isolation according to an example embodiment.
Figure 31:
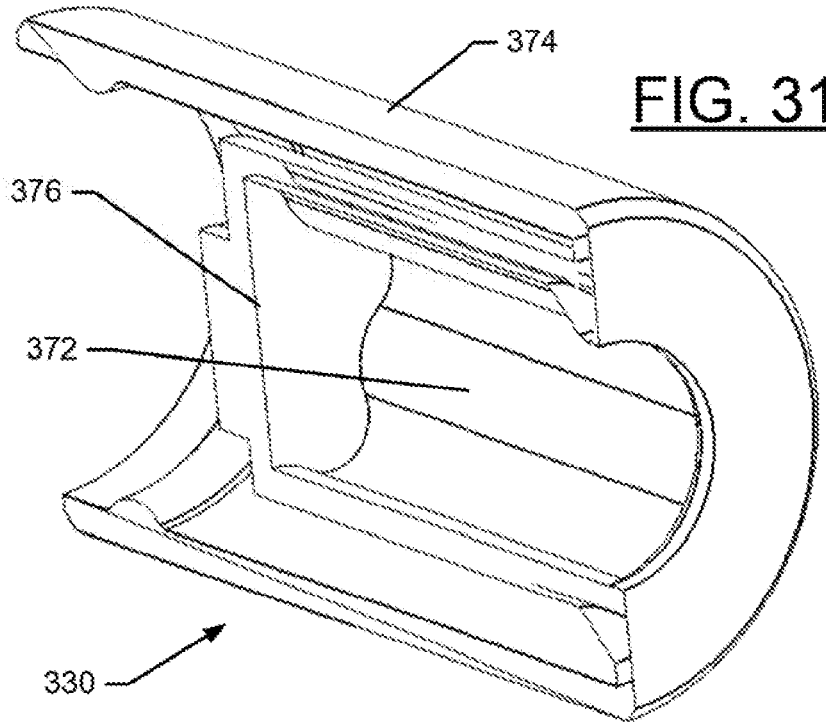
FIG. 31 illustrates a front perspective view of a cross section taken through a center of the isolation assembly along the common axis according to an example embodiment.
Figure 32:
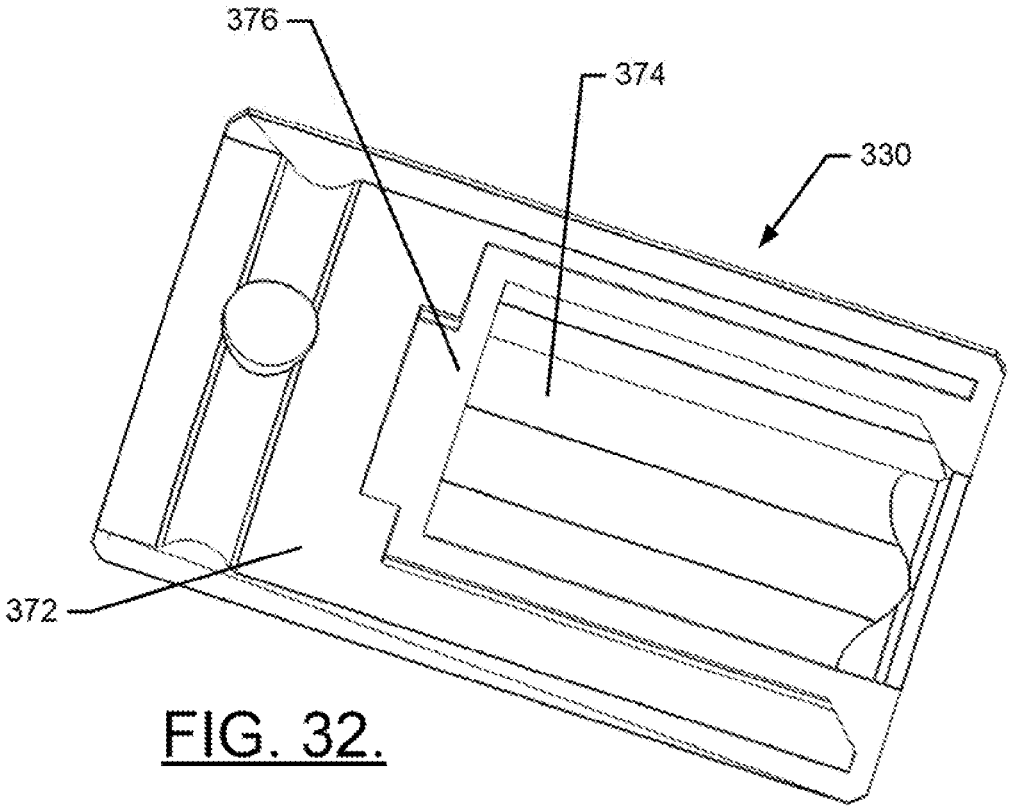
FIG. 32 illustrates a side view of the same cross section shown in FIG. 31 according to an example embodiment.

Referring now to FIGS. 18-32, an adapter 300 of another example embodiment is shown. FIG. 18 illustrates a fully assembled, perspective view of the adapter 300. FIG. 19 illustrates a cross section view of the adapter 300 taken through a center thereof perpendicular to the longitudinal axis of the adapter 300. FIG. 20 illustrates a cross section view taken along the longitudinal axis. FIGS. 21 and 22 illustrate exploded perspective views of the adapter 300 from front and rear perspectives. FIGS. 23 and 24 illustrate isolated perspective views of a drive body 310 and a driven body 320 of the adapter 300 from front perspectives. FIG. 25 illustrates the drive body 310 and driven body 320 assembled prior to injection molding of isolation assembly 330. FIG. 26 illustrates an alternative isolated, front perspective view of a driven body 320 of the adapter 300, and FIG. 27 illustrates a front view of the drive body 310 in isolation. FIGS. 28 and 29 illustrate isolated views of the isolation assembly 330 of the adapter 300 from rear and front perspectives, respectively. FIG. 30 is a cross section view of the isolation assembly 330 taken at a center thereof and perpendicular to the common axis 344. FIG. 31 illustrates a front perspective view of a cross section taken through a center of the isolation assembly 330 along the common axis 344, and FIG. 32 illustrates a side view of the same cross section.

As was the case relative to the examples described above, the drive body 310 and the driven body 320 may be separated from each other by the isolation assembly 330 that is also configured to cover substantially all of the lateral edges of the driven body 320. The drive body 310 and driven body 320 may each be made of steel or another rigid metallic material to enable a relatively short and thin construction without sacrificing strength. The adapter 300 of this example embodiment employs a drive head 340 in the form of a drive square (and a drive receiver 363 also formed to receive a square). Otherwise, the drive body 310 and the driven body 320 may be shaped and structured generally similar to that of the prior examples. As such, for example, drive body 310 may also include drive body shaft 342, which may be configured to extend rearward from the drive head 340 sharing a common axis 344 with the drive head 340 (and the driven body 320).

The drive body shaft 342 is also a splined shaft having a plurality of splines 346 that extend parallel to the common axis 344 along a periphery of the drive body shaft 342. A trench 348 may also be formed between each of the splines 346. This example embodiment includes five splines 346 and five trenches 348. The splines 346 may extend radially outward from a cylindrical core of the drive body shaft 342, and the cylindrical core may again have a diameter similar to the diameter of the drive head 340 measured between opposing corners thereof. In some cases, each of the splines 346 may extend away from the cylindrical core portion by between about 5% and 25% of the diameter of the cylindrical core portion of the drive body shaft 342, and the diagonal length between opposing corners of the drive head 340. Thus, the diameter of the drive body shaft 342 may be no more than 50% larger than the diagonal length between opposing corners of the drive head 340 (and in some cases as little as 10% larger).

The driven body 320 may take the form of a cylinder that has been hollowed out to at least some degree to form a drive body receiver 350 that is formed between sidewalls 352 (which could be considered a single tubular sidewall) of the driven body 320 to define the external peripheral edges of the driven body 320 and radially bound the drive body receiver 350. The sidewalls 352 may extend parallel to the common axis 344 away from a base portion 353, which may be a substantially filled cylinder of metallic material. The sidewalls 352 may include longitudinally extending ridges 354 that extend inwardly from the sidewalls 352 toward the common axis 344. The ridges 354 may be separated from each other by longitudinally extending recesses 356 or grooves to form a corrugated or fluted appearance in cross section. The ridges 354 and recesses 356 may be equal in number to the number of splines 346 and trenches 348 of the drive body 310 and may align therewith after assembly. However, the diameter of the drive body receiver 350 may be larger than the diameter of the drive body shaft 342 so that the ridges 354 remain spaced apart from corresponding portions of the trenches 348 and the spines 346 remain spaced apart from corresponding portions of the recesses 356 to form a gap 370 therebetween. An end of the drive body shaft 342 is also spaced apart from the base portion 353 so that during injection molding, the insulating material may fill the gap 370 and define a corrugated or fluted separator 372 separating the sidewalls 352 from the drive body shaft 242, and thereby also separating the splines 346 and trenches 348 from the recesses 356 and ridges 354, respectively. The insulating material may entirely fill the gap 370 and any other spaces between the drive body 310 and the driven body 320, and may also be molded over the outside surface of the sidewalls 352.

FIGS. 28-32 show the fluted separator 372 and an outer cup 374, which may be substantially similar to the correspondingly named components described above, in isolation from various different perspectives. Meanwhile, distal ends of the fluted separator 374 may be joined by a separation base 376. The separation base 376 may be a plate shaped portion of the isolation assembly 330 that extends perpendicular to the common axis 344 and separates the base portion 353 from the distal end of the drive body shaft 342. Thus, the outer cup 374 may mate with the fluted separator 372 such that the fluted separator 372 is essentially inserted into the outer cup 374. The drive body shaft 342 may be essentially fully encased within the fluted separator 372 and separation base 376 with only the drive head 340 extending out of the isolation assembly 330. Meanwhile, the sidewalls 352 may be fully encased between the fluted separator 372 and the outer cup 374 such that (due to the further coverage provided by the separation base 376) effectively an entirety of the driven body 320 is also nearly fully encased.

As noted above, the fluted separator 372 extends between the sidewalls 352 of the drive shaft body 342, which otherwise overlap (and are coaxial with) each other along the common axis 344. This overlap allows the pressure exerted on each of the ridges 354 of the driven body 320 to be distributed substantially evenly and transmitted to the splines 346 of the drive body 310 through the fluted separator 372. However, since the fluted separator 372 is mutually supported on opposing sides thereof (e.g., by the complementary shapes of the splines 346 and trenches 348 with the recesses 356 and ridges 354, respectively) by the overlapping portions of the drive shaft body 342 and the sidewalls 352, the fluted separator 372 is not prone to breakage even if the fluted separator 372 is made relatively thin (e.g., 0.5 mm to 2 mm). In this example, however, it can be seen that the width of the fluted separator 372 (measured in the radial direction) is slightly larger than the radial length of either or both of the ridges 354 and the splines 346.

The drive heads and drive receivers discussed above may be configured to engage components of different shapes including, for example, a ¼ inch hex drive head (in FIGS. 11-17), a ½ inch drive square (in FIGS. 1-10), and a ⅜ inch drive square in FIGS. 18-31. However, numerous other sizes (and combinations of different sizes between the drive head and the drive receiver) are possible in other example embodiments. As such, for example, the drive head could be a screw driver head, a bit holder head, or any of a number of other driving heads. Thus, an electrically isolated adapter of an example embodiment may include a drive body made of first metallic material extending along a common axis, a driven body made of a second metallic material extending along the common axis, and an isolation assembly formed of insulating material disposed between the drive body and the driven body. The drive body may include a drive head configured to interface with a socket or fastener. The driven body may include a drive receiver configured to interface with a protrusion of a driving tool. A portion of one of the drive body or the driven body is received inside a portion of the other of the drive body or the driven body such that the drive body and driven body overlap each other along the common axis.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. An electrically isolated adapter comprising:

a drive body made of first metallic material extending along a common axis, the drive body comprising a drive head configured to interface with a socket or fastener;

a driven body made of a second metallic material extending along the common axis, the driven body having a drive receiver configured to interface with a protrusion of a driving tool; and an isolation assembly comprising a separator formed of insulating material disposed between the drive body and the driven body wherein the insulating material has a resistance to electrical current that is higher than the resistance to electrical current of at least one of the first metallic material and the second metallic material, wherein a portion of one of the drive body or the driven body is coaxially surrounded by the separator, and wherein the portion of one of the drive body or the driven body and the separator are received inside a portion of the other of the drive body or the driven body such that the portion of one of the drive body or the driven body, the separator, and the portion of the other of the drive body or the driven body coaxially overlap a point on the common axis, wherein the portion of the one of the drive body or driven body includes a plurality of splines that extend radially outward from the common axis and parallel to the common axis with a corresponding plurality of trenches formed therebetween, wherein the other of the drive body or the driven body comprises a receiver formed by sidewalls defining an interior cylindrical surface comprising ridges that extend radially inward towards the common axis and parallel to the common axis with a corresponding plurality of recesses formed therebetween;

wherein the recesses coaxially overlap the splines and the splines extend radially outward into the recesses but are spaced apart from a surface of the sidewalls within the recesses by the separator.

2. The adapter of claim 1, wherein the drive body comprises a drive body shaft extending away from the drive head along the common axis, wherein the driven body comprises a drive body receiver formed by sidewalls that extend parallel to the common axis away from a base portion, and wherein the drive body shaft is received inside the drive body receiver with the isolation assembly separating the drive body from the driven body.

3. The adapter of claim 1, wherein the separator is a fluted separator and the fluted separator is formed as part of the isolation assembly between the drive body shaft and the sidewalls of the driven body to separate the splines from corresponding ones of the recesses and the ridges from corresponding ones of the trenches.

4. The adapter of claim 3, wherein the isolation assembly further comprises an outer cup extending around peripheral edges of the sidewalls and the base portion, and wherein the outer cup receives the fluted separator therein such that a first end of the fluted separator is operably coupled to an interior portion of the outer cup.

5. The adapter of claim 4, wherein a separation base is disposed at a second end of the fluted separator, the separation base being disposed between the base portion and the drive body shaft.

6. The adapter of claim 5, wherein the fluted separator and the base portion are injection molded into a gap defined between the drive body shaft and the driven body.

7. The adapter of claim 4, wherein a width of the fluted separator and a width of the outer cup are substantially equal.

8. The adapter of claim 4, wherein a width of the fluted separator and a width of the outer cup are substantially equal.

9. The adapter of claim 3, wherein a diameter of the drive body shaft is less than a diameter of the drive body receiver by a distance equal to a width of the fluted separator.

10. The adapter of claim 3, wherein torque is transmitted from the splines to the ridges via the fluted separator.

11. The adapter of claim 1, wherein a diameter of the drive head corresponds to a diameter of a cylindrical core of the drive body shaft, and wherein the splines extend away from the cylindrical core by about 5% to about 25% of the diameter of the cylindrical core.

12. The adapter of claim 1, wherein a length of each of the drive body and the driven body is between three and four times a length of the drive head, a length of the adapter is between about four and five times the length of the drive head.

13. The adapter of claim 1, wherein a width of the drive body is less than 50% larger than a width of the drive head, and wherein a width of the adapter is less than three times the width of the drive head.

14. The adapter of claim 1, wherein a maximum diameter of the drive body shaft is greater than a minimum diameter of the driven body at the portion of the driven body at which the sidewalls are disposed.

15. The adapter of claim 1, wherein an entirety of the driven body other than a driven end is encased in the isolation assembly, and an entirety of the drive body other than the drive head is encased in the isolation assembly.

16. The adapter of claim 1, wherein the first metallic material and the second metallic material are each stainless steel.

17. A driver extension comprising:

a head having a first end configured to mate with a driver and a second end having a plurality of splines disposed around an outer circumference of the second end and extending along a common axis and radially outward from the common axis with a corresponding plurality of trenches formed therebetween, the head being made of a first material;

a tail having a third end comprising an opening having an interior cylindrical surface with a plurality of ridges extending along the common axis and a plurality of recesses extending along the common axis, the ridges extending radially inward toward the common axis from the interior cylindrical surface of the opening, the tail also having a fourth end configured to mate with a driven body, the tail being made of a second material;

a body comprising a separator made of a material that has a resistance to electrical current that is greater than the resistance to electrical current of at least one of the first material and second material, the separator being at least partially disposed between the head and the tail;

wherein the separator coaxially surrounds the second end of the head;

wherein the second end and the separator are disposed within the opening of the third end such that the second end, the separator, and the third end coaxially overlap a point on a common axis;

wherein the recesses coaxially overlap the splines and the splines extend radially outward into the recesses but are spaced apart from a surface of the recesses by the separator.

18. An electrically isolated adapter comprising:

a drive body made of first metallic material extending along a common axis, the drive body comprising a drive head configured to interface with a socket or fastener and a drive body shaft extending away from the drive head along the common axis, the drive body shaft comprising a plurality of splines that extend radially outward from the common axis and parallel to the common axis with a corresponding plurality of trenches formed therebetween;

a driven body made of a second metallic material extending along the common axis, the driven body comprising a drive receiver configured to interface with a protrusion of a driving tool and a drive body receiver formed by sidewalls defining an interior cylindrical surface comprising ridges that extend radially inward towards the common axis and parallel to the common axis with a corresponding plurality of recesses formed therebetween; and a separator formed of insulating material disposed between the drive body and the driven body wherein the insulating material has a resistance to electrical current that is higher than the resistance to electrical current of at least one of the first metallic material and the second metallic material;

wherein the drive body shaft is received inside the drive body receiver with the separator separating the drive body from the driven body;

wherein a diameter of the drive body shaft is less than a diameter of the drive body receiver by a distance equal to a width of the separator;

wherein the recesses of the driven body coaxially overlap the splines of the drive body and the splines extend radially outward into the recesses but are spaced apart from a surface of the sidewalls within the recesses by the separator.

* * * * *